US005958662A

United States Patent [19]

Merkel et al.

[11] Patent Number: 5,958,662

[45] Date of Patent: Sep. 28, 1999

[54] PHOTOGRAPHIC ELEMENT CONTAINING A DIR COUPLER

[75] Inventors: Paul B. Merkel, Victor; David A. Steele, Webster; Jerrold N. Poslusny, Rochester, all of N.Y.

[73] Assignee: Eastman Kodak Company, Rochester, N.Y.

[21] Appl. No.: 08/824,226

[22] Filed: Mar. 25, 1997

[51] Int. Cl.[6] ..... G03C 1/08; G03C 7/26; G03C 7/32

[52] U.S. Cl. ..... 430/544; 430/505; 430/957; 430/555; 430/955

[58] Field of Search ..... 430/505, 543, 430/544, 555, 955, 957

[56] References Cited

U.S. PATENT DOCUMENTS

| | | | |
|---|---|---|---|
| Re. 29,379 | 8/1977 | Shiba et al. | 430/543 |
| Re. 31,893 | 5/1985 | Sugita et al. | 430/957 |
| 5,091,293 | 2/1992 | Nozawa et al. | 430/503 |

FOREIGN PATENT DOCUMENTS

| | | |
|---|---|---|
| 4027373A1 | 3/1992 | Germany . |
| 4-278942 | 3/1978 | Japan . |

*Primary Examiner*—Geraldine Letscher
*Attorney, Agent, or Firm*—Edith A. Rice

[57] ABSTRACT

A photographic element, comprises a support bearing one or more silver halide emulsions and one or more pyrazolone magenta dye-forming DIR couplers of structure I or II:

I

II wherein:

the $R_1$ substituents are individually selected from the group consisting of halogen atoms and alkyl, phenyl, alkoxy, phenoxy, carbonamido, sulfonamido, carbamoyl, alkoxycarbonyl, aryloxcarbonyl, and trifluoromethyl groups;

n is 1 to 5;

$R_2$ is an alkyl group or a phenyl group; and $R_3$ is a substituent containing at least 2 carbon atoms and selected from the group consisting of an alkylthio group, an arylthio group, an alkoxy group, an phenoxy group or a carbonamido group of the formula: —$NHCOR_4$, wherein $R_4$ is an alkyl group, a phenyl group, an alkoxy group or a phenoxy group.

18 Claims, No Drawings

PHOTOGRAPHIC ELEMENT CONTAINING A DIR COUPLER

FIELD OF THE INVENTION

This invention relates to a photographic element containing a magenta DIR coupler.

BACKGROUND OF THE INVENTION

Many photographic materials, particularly color negative films, contain so-called DIR (development inhibitor releasing) couplers. In addition to forming imaging dye, DIR couplers release inhibitors that can restrain silver development in the layer in which release occurs as well as in other layers of a multilayer photographic material. DIR couplers can help control gamma (contrast), can enhance sharpness (acutance), can reduce granularity and can provide color correction via interlayer interimage effects. U.S. Pat. No. 3,933,500 broadly discloses DIR couplers with azole-type coupling off groups, including pyrazolone coulers. Specificaly U.S. Pat. No. 3,933,500 discloses DIR couplers having a simple purine coupling off group. This simple purine is a relatively ineffective inhibitor of silver development.

PROBLEM TO BE SOLVED BY THE INVENTION

There has been a need for more effective magenta dye-forming DIR couplers. DIR couplers that release inhibitors that efficiently reduce silver development are desired. In addition it is desirable that such couplers have high reactivity to maximize rates and efficiencies of inhibitor release and minimize DIR coupler laydowns. It is also necessary that the magenta DIR couplers be stable toward long term storage or toward storage at elevated temperatures. DIR couplers that show acceptably low continued coupling when films containing them are placed in a bleach solution immediately after development (i.e. with no intervening stop bath) are also needed. The DIR couplers of this invention possess all of these desirable properties, particularly high activity and good stability. They are also easily synthesized.

SUMMARY OF THE INVENTION

This invention relates to a photographic element comprising a support bearing one or more silver halide emulsions and one or more pyrazolone magenta dye-forming DIR couplers of structure I or II, below:

I

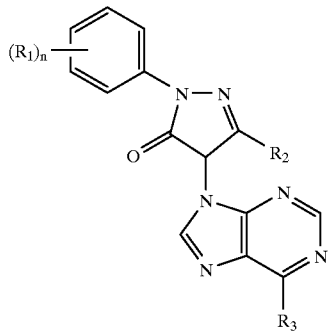

-continued

II

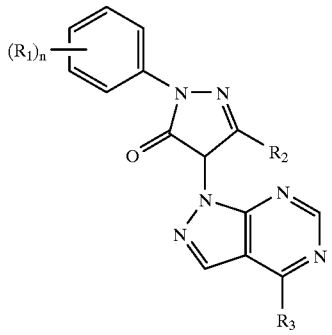

wherein:

the $R_1$ substituents are individually selected from the group consisting of halogen atoms and alkyl, phenyl, alkoxy, phenoxy, carbonamido, sulfonamido, carbamoyl, alkoxycarbonyl, aryloxcarbonyl, and trifluoromethyl groups;

n is 1 to 5;

$R_2$ is an alkyl group or a phenyl group; and $R_3$ is a substituent containing at least 2 carbon atoms and selected from the group consisting of an alkylthio group, an arylthio group, an alkoxy group, an phenoxy group or a carbonamido group of the formula: —$NHCOR_4$, wherein $R_4$ is an alkyl group, a phenyl group, an alkoxy group or a phenoxy group.

ADVANTAGEOUS EFFECT OF THE INVENTION

The DIR couplers of the invention have high activity, good stability and are easily synthesized.

DETAILED DESCRIPTION OF THE INVENTION

In the DIR couplers of structure I or II, preferably, at least one ortho position of the 1-phenyl ring is unsubstituted to maintain high coupler reactivity. In one useful embodiment n=1 and $R_1$ is a carbonamido group in the 4-position relative to the pyrazolone nitrogen. In another embodiment, n=1 and $R_1$ is a halogen atom, such as fluorine, chlorine or bromine. In another useful embodiment $R_2$ is an alkyl group, such as a methyl or ethyl group. In another useful embodiment $R_3$ is an alkylthio group with 2 to 14 carbon atoms. Preferably $R_3$ is a group that readily hydrolyzes in developer solution to prevent seasoning by accumulation of strong inhibitors. A half-life for hydrolysis of no more than 60 min in KODACOLOR C-41 developer at 100° F. (38° C.) is desirable. In one preferred embodiment $R_3$ is an —$SCH_2CO_2R_5$ group, wherein $R_5$ is an alkyl group with 2 to 12 carbon atoms, preferably 3 to 8 carbon atoms, or a phenyl group with up to 12 carbon atoms. In another useful embodiment $R_3$ is an carbonamido group with at least 5 carbon atoms and preferably 6 to 12 carbon atoms. The required or preferred numbers of carbon atoms in $R_3$ helps ensure that the released inhibitor has sufficient hydrophobicity to efficiently adsorb to silver or silver halide and efficiently inhibit silver development. Preferably the photographic elements of this invention comprise the DIR couplers of this invention in the same layer with one or more green-sensitive silver halide emulsions. The alkyl substituents comprising $R_1$, $R_2$, $R_4$ and $R_5$ may be branched, unbranched or cyclic and may be unsubstituted or substituted. The alkoxy groups comprising $R_1$, $R_3$ and $R_4$ may be unbranched or branched and may be substituted or unsubstituted. The phenyl groups comprising $R_1$, $R_2$, $R_4$ and $R_5$ the phenoxy groups comprising $R_1$, $R_3$ and $R_4$ and the arylthio groups comprising $R_3$ may be unsubstituted or substituted. The alkylthio groups comprising $R_3$ may be unbranched or branched and unsubstituted or substituted. The carbonamido groups comprising $R_1$ and $R_3$, and the sulfonamido, carbamoyl, alkoxycarbonyl and aryloxycarbonyl groups comprising $R_1$ may be further substituted. Any substituent may be chosen to further substitute the $R_1$–$R_5$ groups of this invention that does not adversely affect the performance of the pyrazolone DIR couplers of this invention. Suitable substituents include halogen atoms, such as chlorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy- and alkylamino-carbonamido groups), carbamoyl groups, carbamoyloxy groups, sulfonamido groups, sulfamoyl groups, alkylthio groups, arylthio groups, sulfoxyl groups, sulfonyl groups, sulfonyloxy groups, alkoxysulfonyl groups, aryloxysulfonyl groups, trifluoromethyl groups, cyano groups, imido groups and heterocyclic groups, such as 2-furyl, 3-furyl, 2-thienyl, 1-pyrrolyl, 2-pyrrolyl, 1-imidazolyl and N-succinimidyl groups. The phenyl groups comprising $R_1$, $R_2$, $R_4$ and $R_5$ and the phenoxy groups comprising $R_1$, $R_3$ and $R_4$ may also be substituted with one or more unbranched, branched or cyclic alkyl groups.

Useful coated levels of the magenta dye-forming pyrazolone DIR couplers of this invention range from about 0.005 to about 0.40 g/sq m, or more typically from 0.01 to 0.20 g/sq m. The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred.

Examples of pyrazolone DIR couplers of this invention include, but are not limited to , A1–A12, below:

A1

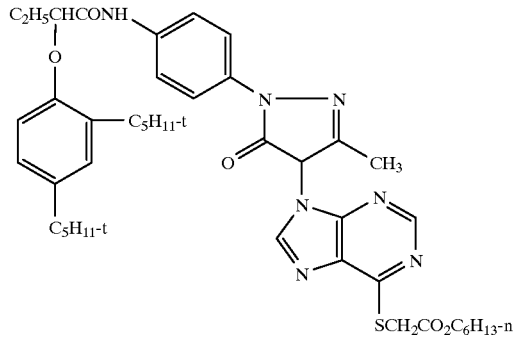

A2

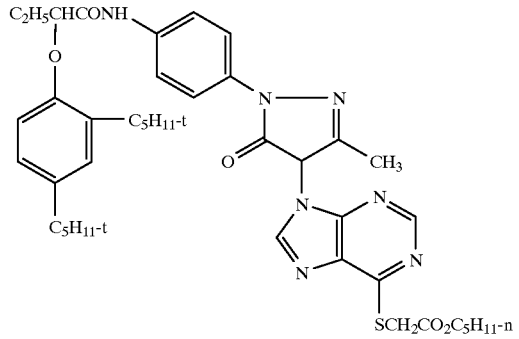

A3

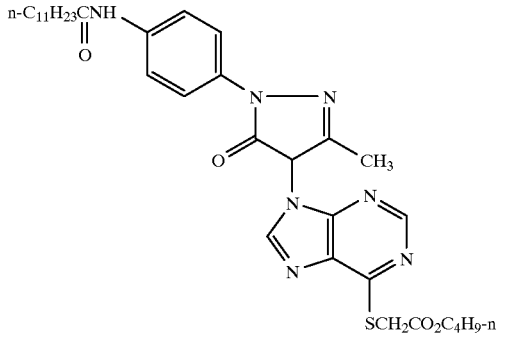

A4

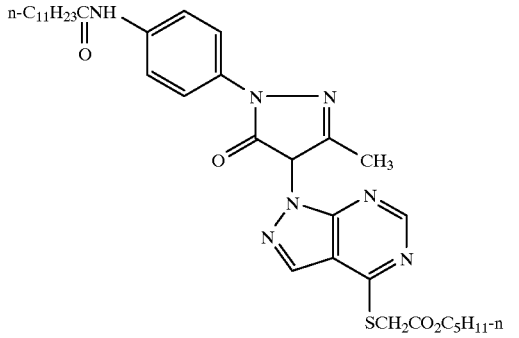

-continued
A5
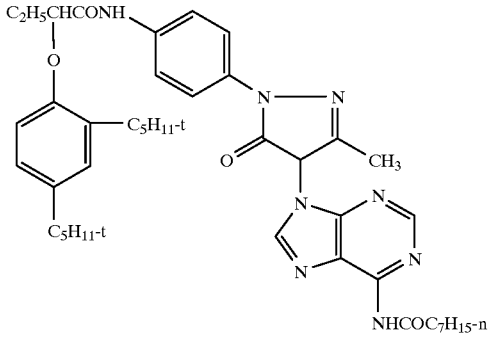
A6
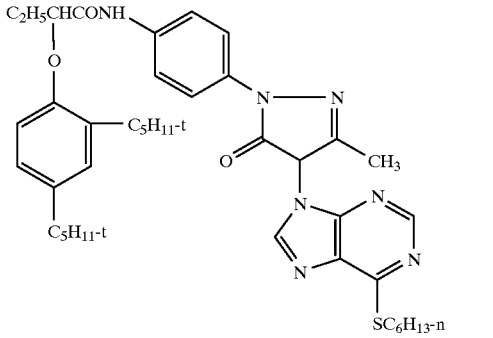
A7
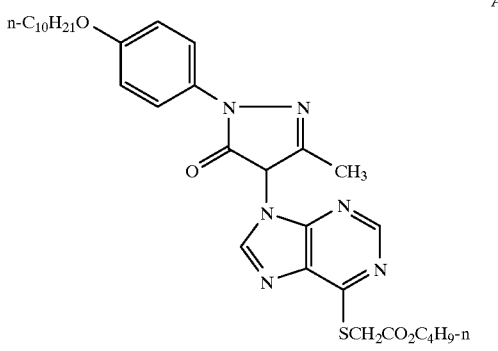
A8
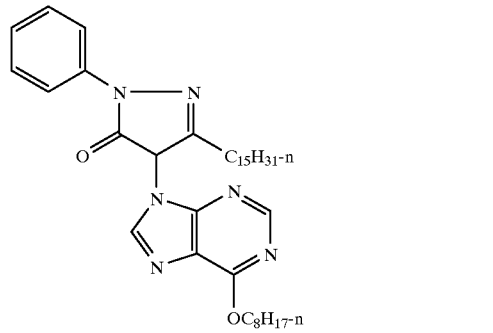
-continued
A9
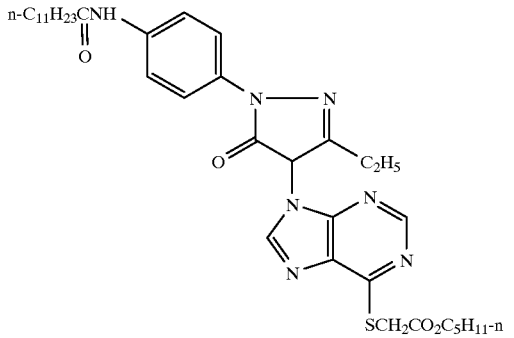
A10
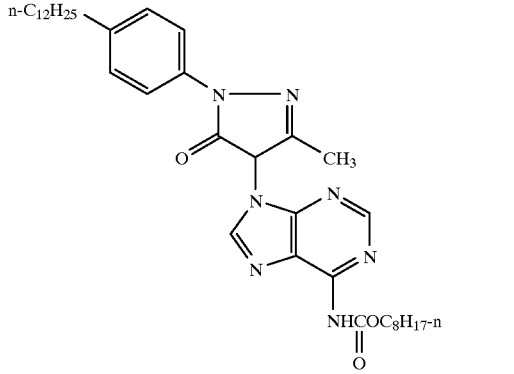
A11
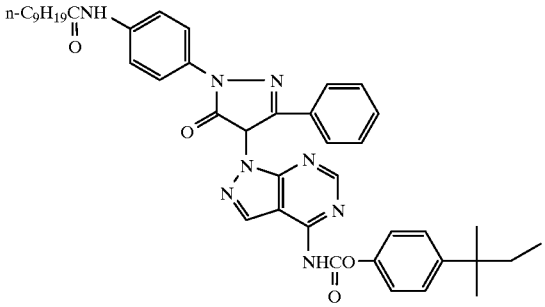
A12
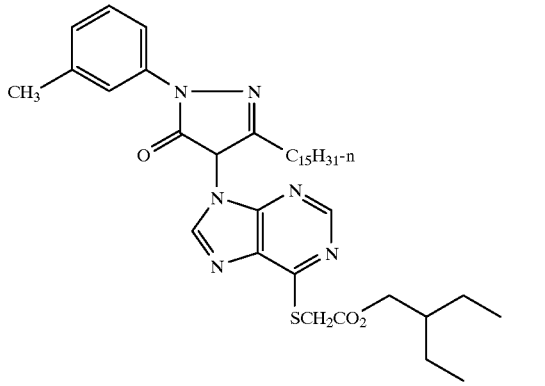

-continued

A13

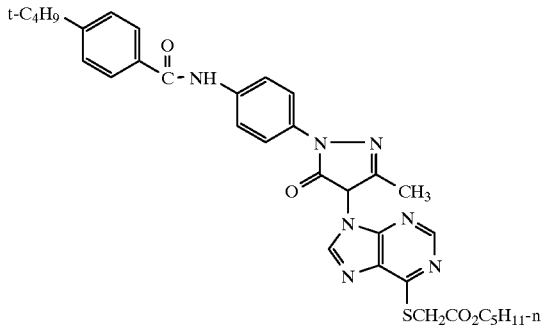

The pyrazolone DIR couplers of this invention may be used together with a variety of other types of couplers in the same layer or in different layers of a multilayer photographic material. Specifically contemplated is the use of pyrazolone DIR couplers of this invention in green-sensitive photographic elements together with one or more 1-phenyl-3-anilino-5-pyrazolone magenta dye-forming imaging couplers as defined in U.S. Pat. No. 5,200,309 of Merkel and Singer, the entire disclosures of which are incorporated herein by reference. These preferred dye-forming couplers are of the formula:

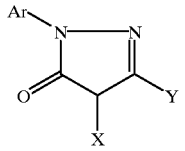

wherein:

Ar is selected from the group consisting of unsubstituted aryl groups, substituted aryl groups and substituted pyridyl groups, the substituents being selected from the group consisting of halogen atoms and cyano, alkyolsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl and trifluoromethyl groups;

Y is selected from the group consisting of anilino, acylamino and ureido groups and one of said groups substituted with one or more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl alkylthio, nitro, carboxyl and hydroxyl groups, and groups which form a link, to a polymeric chain, and wherein Y contains at least 6 carbon atoms; and X is a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups.

Y is preferably of the formula:

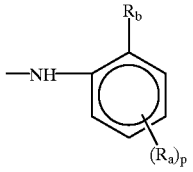

wherein:

p is from zero to 2 and each $R_a$ is in a meta or para position with respect to $R_b$;

each $R_a$ is individually selected from the group consisting of halogen atoms and alkyl, alkoxy, aryloxy, carbonamido, carbamoyl, sulfonamido, sulfamoyl, alkylsulfoxyl, aryl sulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups; and $R_b$ is selected from the group consisting of hydrogen, halogen atoms and alkyl, alkoxy, aryloxy, alkylthio, carbonamido, carbamoyl, sulfonamido, sulfamoyl, aLkylsulfonyl, arylsulfonyl, alkoxycarbonyl, acyloxy, acyl, cyano, nitro and trifluoromethyl groups.

X is preferably of the formula:

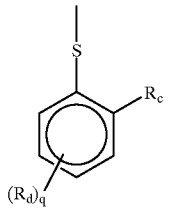

wherein:

$R_c$ and $R_d$ are individually selected from the group consisting of hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; q is 0, 1 or 2; and $R_d$ may be in the meta or para position with respect to the sulfur atom.

Particularly contemplated is the use of the pyrazolone DIR couplers of this invention in combination with M-1 or M-2 below.

M-1

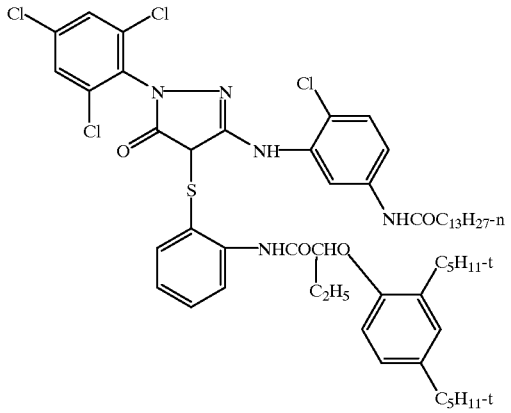

M-2

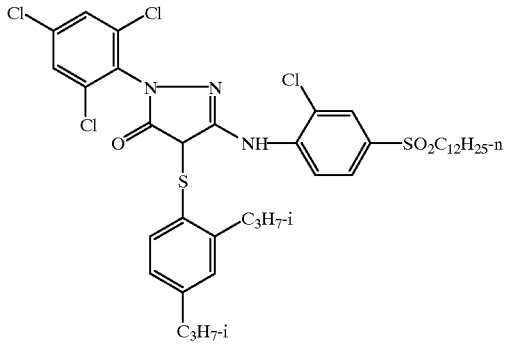

Also specifically contemplated is the use of pyrazolone DIR couplers of this invention in green-sensitive photographic elements together with one or more magenta couplers comprising a pyrazole or imidazole ring compound containing one or more fused rings. Typically, the compound may be represented by one of the formulas:

IA

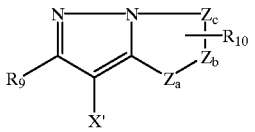

or

IB

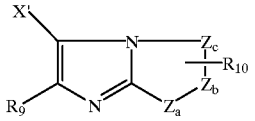

wherein $R_9$ and each $R_{10}$ are independently hydrogen or substituents that do not prevent the coupling reaction of the coupler; X' is hydrogen or a coupling-off group known in the photographic art; and $Z_a$, $Z_b$ and $Z_c$ are independently selected from the group consisting of a substituted or unsubstituted methine group, =N—, =C< or —NH—, provided that one of either the $Z_a$-$Z_b$ bond or the $Z_b$-$Z_c$ bond is a double bond and the other is a single bond, and when the $Z_b$-$Z_c$ bond is a carbon—carbon double bond, it may form part of an aromatic ring.

The azole coupler contains in the coupling position, represented by X', either hydrogen or a coupling-off group.

Coupling-off groups are known to those skilled in the art. Such groups can determine the equivalency of the coupler, can modify the reactivity of the coupler, or can advantageously affect the layer in which the coupler is coated or other layers in the element by performing, after release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclylimido, thiocyano, alkylthio, arylthio, heterocyclylthio, sulfonamido, phosphonyloxy and arylazo. They are described in, for example, U.S. Pat. Nos. 2,355,169; 3,227,551; 3,432,521; 3,476,563; 3,617,291; 3,880,661; 4,052,212 and 4,134,766; and in U.K. patents and published application numbers 1,466,728; 1,531,927; 1,533,039; 2,006,755A 2,017,704A; and in EP 285,274.

Generally, at least one of $R_9$ and $R_{10}$ contains a ballast group where the ballast group is an organic radical of such size and configuration as to confer on the coupler molecule sufficient bulk to render the coupler substantially non-diffusible from the layer in which it is coated in a photographic element. Thus, the combination of groups $R_9$ and $R_{10}$ from the formula are chosen to meet this criteria as can be determined by one skilled in the art.

Typical pyrazolo-[3,2-c]-1,2,4-triazole magenta image dye-forming couplers within the described structure are disclosed in, for example, U.S. Pat. Nos. 4,443,536; 4,777,121; 4,808,502; 4,835,094; 4,960,685; and 5,019,489; and European Patents 284,240 and 285,274, the entire disclosures of which are incorporated herein by reference.

Typical pyrazolo-[1,5-b]-1,2,4-triazole couplers are described in, for example, U.S. Pat. Nos. 4,540,654; 4,659,652; 4,774,172; 4,822,730; and 4,925,781; Japanese Published Patent Application No. 61-147254; and European Patents 119,860; 226,849; 234,428; and 294,785, the entire disclosures of which are incorporated herein by reference.

Typical imidazole compounds are exemplified in PCT patent publication WO 92/12464, the entire disclosure of which is incorporated herein by reference.

Use of the pyrazolone DIR couplers of this invention in color negative films comprising magnetic recording layers is also specifically contemplated. The efficient DIR couplers of this invention may allow reductions in the levels of yellow-colored magenta dye-forming masking couplers in such films, thereby lowering blue minimum densities, which may otherwise be undesirably high.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,1163,669; U.S. Pat. No. 4,865,956; and U.S. Pat. No. 4,923,784 are particularly useful. Also contemplated is the use of nucleating agents, development accelerators or their precursors (U.K. Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956, 269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540, 653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072, 633; 90-072,634; 90-077,822; 90-078,229; 90-078,230; 90-079,336; 90-079,338; 90-079,690; 90-079,691; 90-080, 487; 90-080,489; 90-080,490; 90-080,491; 90-080,492; 90-080,494; 90-085,928; 90-086,669; 90-086,670; 90-087, 361; 90-087,362; 90-087,363; 90-087,364; 90-088,096; 90-088,097; 90-093,662; 90-093,663; 90-093,664; 90-093, 665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally>90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of<0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 mm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexa-coordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following examples illustrate the synthesis and use of DIR couplers in accordance with the invention.

EXAMPLE 1

Synthesis of a Representative Purine-Releasing Pyrazolone

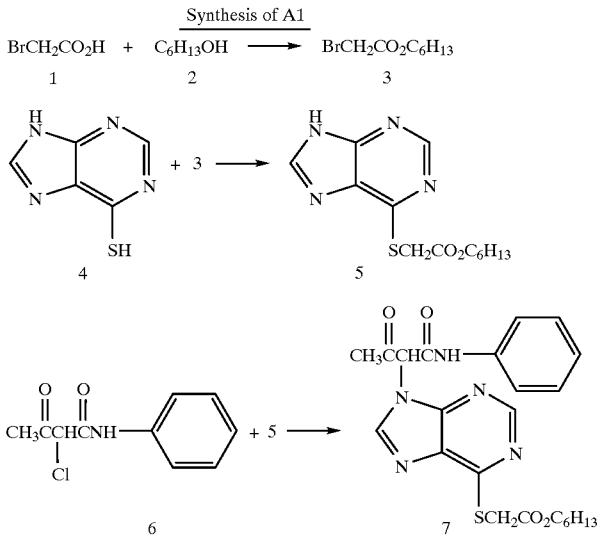

-continued

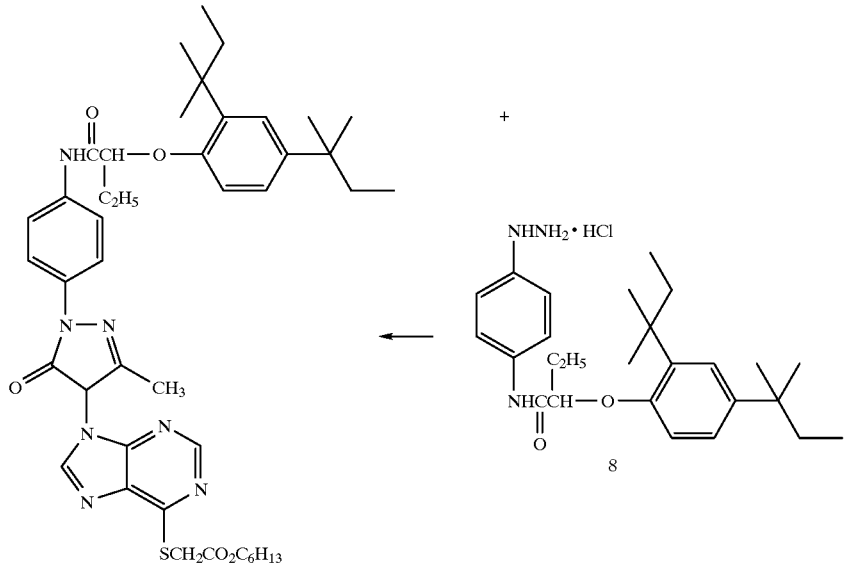

Synthesis of Hexyl-Bromoacetate 3:

A solution of 22 grams (0.16 moles) of bromoacetic acid 1, 20 mLs (0.16 moles) of hexyl alcohol 2 and a catalytic amount of dimethylaminopyridine (DMAP) in 800 mL of dichloromethane were stirred together at room temperature. 34 g (0.16 moles) of dicyclohexylcarbodiimide (DCC) in 200 mL of dichloromethane was then added dropwise. After addition was complete, the reaction was stirred at room temperature for 30 minutes. The solid that precipitated was removed by filtration and discarded. The solvent was removed under vacuum. The structure was confirmed by NMR spectroscopy. The resulting oil was used without further purification in the preparation of 5.

Synthesis of 5.

A solution of 25 grams of 6-mercaptopurine, (0.15 moles) 4 and 7.9 grams of sodium methoxide (0.15 moles) in methanol (700 mLs) was treated in one portion with hexyl-bromoacetate 3. The solution was stirred at ambident temperatures for 1.5 hours. The reaction was diluted with 800 mLs of water. Within one hour, a solid formed. This was filtered and air dried to give 41.7 grams of 5 (94%). The structure was confirmed by NMR spectroscopy.

Synthesis of 7

A solution of 7.2 grams (0.034 moles) of 6 and 10 grams (0.034 moles) of 5 in dimethylformamide was treated with tetramethylguandine and warmed to 50° C. for 2 hours. The reaction was poured into dilute hydrochloric acid. The product was extracted with ethyl acetate. The organic layer was dried with magnesium sulfate and concentrated to an oil. The oil was purified by column chromatography. The resulting material solidified on stirring under ligroins. This was filtered and air dried to give 4.1 grams of a white solid (27%). The sturcture was confirmed by NMR spectroscopy.

Synthesis of A1.

4.1 grams of 7 (0.009 moles) and 4.1 grams (0.009 moles) of 8 were slurried in acetic acid and heated to 75° C. for 3 hours. The reaction was poured into water and extracted into ethyl acetate. The organic layer was washed with brine and dried with magnesium sulfate. This was concentrated to a red oil. The oil was purified by column chromatography, eluting with CH2Cl2/CH3CN/HOAc (80/19/1). The product was obtained as a foam after removal of the solvent under reduced pressure. This was slurried in ligroins, filtered and air dried to give 2.1 grams of A1 (30%). The structure was confirmed by NMR spectroscopy and Mass spectroscopy.

EXAMPLE 2

This example illustrates the gamma reduction and stability provided by the coupler of a photographic element incorporating a DIR coupler of this invention.

To illustrate the superior interlayer interimage and keeping provided by the pyrazolone DIR couplers of this invention, coupler A1 of this invention and comparative magenta dye-forming DIR coupler C1 were evaluated in the multilayer causer/receiver format shown in Table I. Laydowns in g/sq.m are given in parantheses. Structures of components not shown previously are provided after Table I. Both DIR couplers were dispersed at a 1:2 weight ratio in tritolyl phosphate (S-1, mixed isomers). The dispersions were prepared by adding an oil phase containing a 1:2:3 weight ratio of DIR coupler:S-1: ethyl acetate to an aqueous phase containing gelatin and the dispersing agent ALKANOL XC (Dupont) in a 10:1 weight ratio. The mixture was then passed through a colloid mill to disperse the oil phase in the aqueous phase as small particles. On coating, the ethyl acetate auxiliary solvent evaporates. Coupler M-1 was coated with S-1 and ST-1 (see below) at a 1:0.8:0.2 weight ratio. Film samples were given a sensitometric white light (neutral) exposure and processed in a standard KODAK FLEXICOLOR C-41 process. Green (causer) and red (receiver) status M densities vs exposure were then measured for film A without DIR coupler, film B with comparative DIR coupler C1 and film C containing DIR coupler A1 of this invention. Both C1 and A1 were coated at a level of 172 micro moles/sq m. Green and red gamma values were then obtained from slopes of the plots of density vs log exposure. For high interlayer interimage and high color correction it is desirable that a DIR coupler provide minimal reduction in gamma in its own layer (causer gamma), but substantial gamma reduction in receiver layers. In this case green gamma corresponds to causer gamma and red gamma to receiver gamma. For uninhibited film A, green and red gammas are 1.365 and 1.163, respectively. For film B with comparative coupler C1, green and red gammas are reduced to 1.023 and 0.810, respectively. For film C with coupler A1 of this invention, green and red gammas are reduced to 1.098 and 0.818, respectively. The ratio R of red gamma to green gamma provides a measure of the amount of interlayer interimage, with a lower value indicating greater interimage. The ratio R is reduced from 0.85 with no DIR coupler (film A) to 0.79 with comparative coupler C1 (film B) and to 0.74 with coupler A1 of this invention (film C).

TABLE I

OVERCOAT: Gelatin (2.69)
Bis(vinylsulfonyl)methane Hardener (0.227)
CAUSER: M-1 (0.43) & S-1 (0.344) & ST-1 (0.086)
A) No DIR Coupler (Uninhibited Check)
B) C1 (0.129) & S-1 (0.258) Comparative
or C) A1 (0.135) & S-1 (0.270) Invention
Green-Sens. Silver Iodobromide T-Grain Emulsion (0.807 Ag)
Gelatin (2.69)
INTERLAYER: IS-1 (0.054) & S-1 (0.054)
Gelatin (0.86)
RECEIVER: CC-1 (0.753) & S-2 (0.753)
B-2 (0.054) & S-3 (0.054)
IR-5 (0.022) & S-5 (0.044)
Red-Sens. Silver Iodobromide T-Grain Emulsion (0.807 Ag)
Gelatin (2.69)
Cellulose Acetate Support with Gel U-Coat and Antihalation Backing

C1

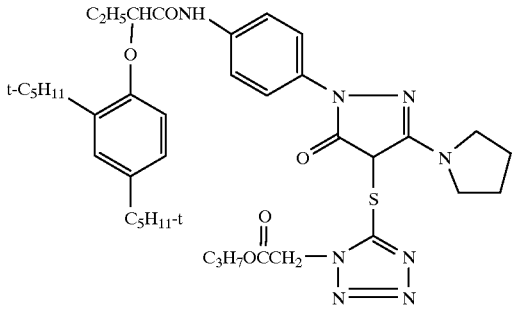

CC-1

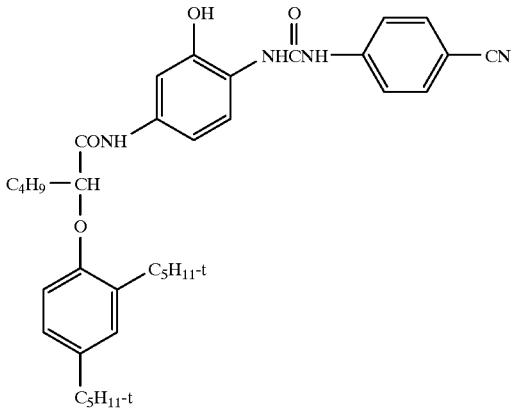

TABLE I-continued

S-1

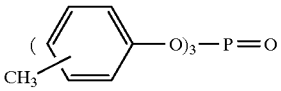

mixed isomers

ST-1

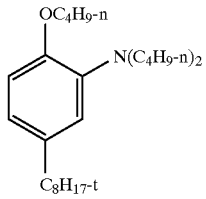

IS-1

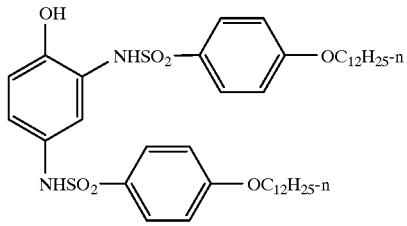

IR-5

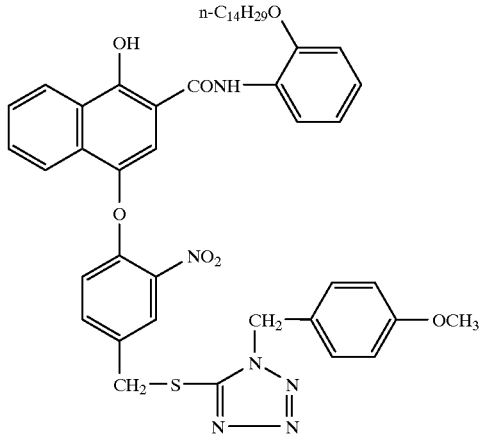

B-2

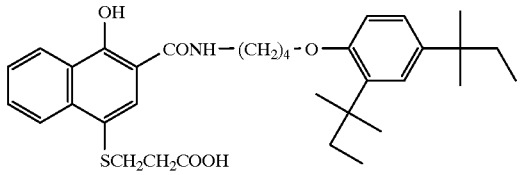

S-2

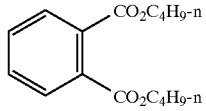

S-3

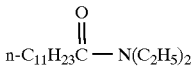

S-5

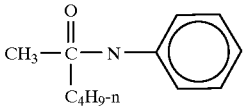

From the comparative data above it is evident that DIR coupler A1 effectively reduces gamma in both causer and receiver layers. Furthermore, it provides a slight advantage over comparative coupler C1 in terms of interlayer interimage. While these features are notable, the major advantage of DIR coupler A1 relative to comparative coupler C1 is the much superior stability of DIR A1. To evaluate keeping or stability of the DIR couplers, one set of unexposed and unprocessed samples of films B and C was placed in a freezer at −4° C. and a second set was incubated for two weeks at 60° C., 50% RH. The DIR couplers were then extracted from both sets of films and analyzed by high performance liquid chromatography, and the levels of DIR coupler remaining were compared for the incubated films relative to the freezer checks in which no decomposition occurred. While 34% of comparative coupler C1 was lost from film B after incubation, surprisingly only 2% of coupler A1 was lost from film C. Coupler A1 of this invention also yields a superior magenta dye hue in comparison to coupler C1, thereby providing better color reproduction.

The invention has been described in detail with particular reference to preferred embodiments, but it will be understood that variations and modifications can be effected within the spirit and scope of the invention.

What is claimed is:

1. A photographic element, comprising a support bearing one or more silver halide emulsions and one or more pyrazolone magenta dye-forming DIR couplers of structure I or II:

I

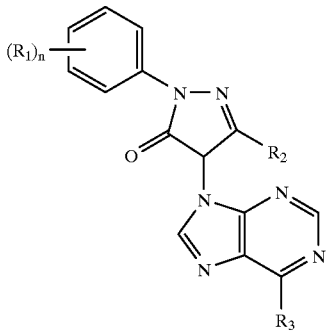

II

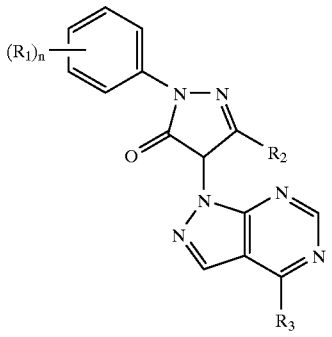

wherein:

the $R_1$ substituents are individually selected from the group consisting of halogen atoms and alkyl, phenyl, alkoxy, phenoxy, carbonamido, sulfonamido, carbamoyl, alkoxycarbonyl, aryloxcarbonyl, and trifluoromethyl groups;

n is 1 to 5;

$R_2$ is an alkyl group or a phenyl group; and $R_3$ is a substituent containing at least 2 carbon atoms and selected from the group consisting of an alkylthio group, an arylthio group, an alkoxy group, an phenoxy group or a carbonamido group of the formula: —$NHCOR_4$, wherein $R_4$ is an alkyl group, a phenyl group, an alkoxy group or a phenoxy group.

2. A photographic element according to claim 1 comprising a silver halide emulsion layer sensitive to green light and the pyrazolone DIR coupler is in the green-sensitive layer.

3. A photographic element according to claim 1, wherein n is 1 and $R_1$ is a carbonamido group in the 4-position relative to the pyrazolone nitrogen.

4. A photographic element according to claim 1, wherein $R_2$ is an alkyl group.

5. A photographic element according to claim 4, wherein $R_2$ is methyl or ethyl.

6. A photographic element according to claim 1, wherein $R_3$ is an alkylthio group with 2 to 14 carbon atoms.

7. A photographic element according to claim 6, wherein $R_3$ is a hydrolyzable —$SCH_2CO_2R_5$ group, wherein $R_5$ is an alkyl group with 2 to 12 carbon atoms or a phenyl group with up to 12 carbon atoms.

8. A photographic element according to claim 7, wherein n is 1 and $R_1$ is a carbonamido group in the 4-position relative to the pyrazolone nitrogen.

9. A photographic element according to claim 7, wherein $R_2$ is a methyl or ethyl group.

10. A photographic element according to claim 1, wherein $R_3$ is a carbonamido group with 6 to 12 carbon atoms.

11. A photographic element according to claim 1, wherein at least one ortho position of the 1-phenyl ring is unsubstituted.

12. A photographic element according to claim 1, wherein the pyrazolone DIR coupler is selected from the group consisting of:

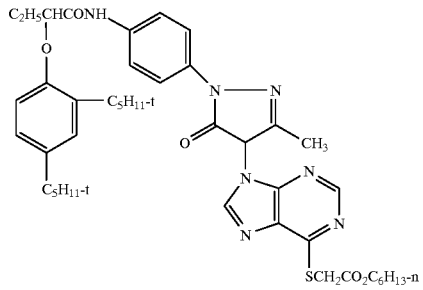

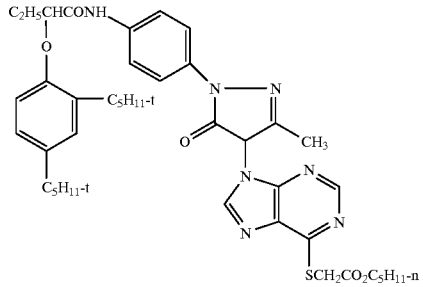

-continued

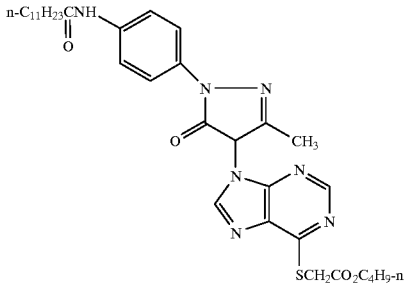

and

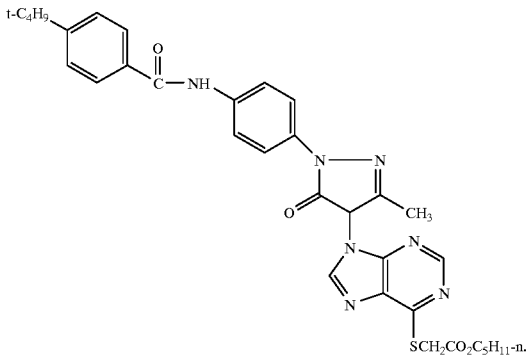

13. A photographic element according to claim 1, wherein the coated level of DIR coupler of structure I or II is between 0.005 and 0.40 g/sq m.

14. A photographic element according to claim 1, further comprising one or more 1-phenyl-3-anilino-5-pyrazolone magenta dye-forming imaging couplers of structure:

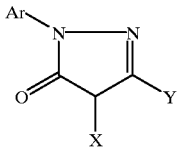

wherein:

Ar is selected from the group consisting of unsubstituted aryl groups, substituted aryl groups and substituted pyridyl groups, the substituents being selected from the group consisting of halogen atoms and cyano, alkyolsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl and trifluoromethyl groups;

Y is selected from the group consisting of anilino, acylamino and ureido groups and one of said groups substituted with one or more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyl, acyloxy, ureido, imido, carbamate, heterocyclic, cyano, trifluoromethyl alkylthio, nitro, carboxyl and hydroxyl groups, and groups which form a link, to a polymeric chain, and wherein Y contains at least 6 carbon atoms; and X is a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups.

15. A photographic element according to claim 14, wherein Y is of the formula:

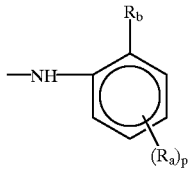

wherein:

p is from zero to 2 and each $R_a$ is in a meta or para position with respect to $R_b$;

each $R_a$ is individually selected from the group consisting of halogen atoms and alkyl, alkoxy, aryloxy, carbonamido, carbamoyl, sulfonamido, sulfamoyl, alkylsulfoxyl, aryl sulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups; and $R_b$ is selected from the group consisting of hydrogen, halogen atoms and alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

16. A photographic element according to claim 15, wherein X is of the formula:

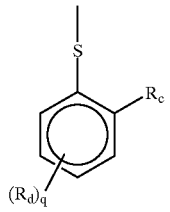

wherein:

$R_c$ and $R_d$ are individually selected from the group consisting of hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; q is 0, 1 or 2; and $R_d$ may be in the meta or para position with respect to the sulfur atom.

17. A photographic element according to claim 16, wherein the magenta dye-forming imaging coupler is

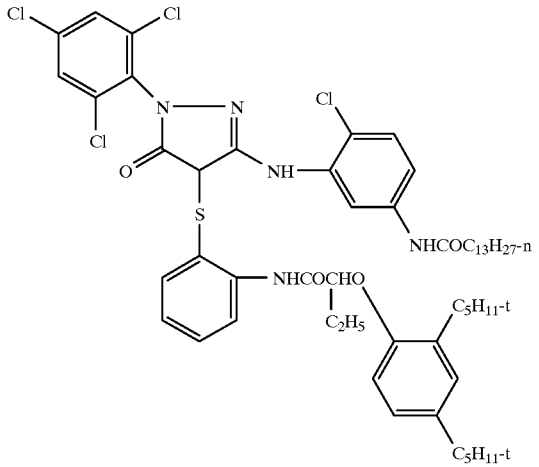

or

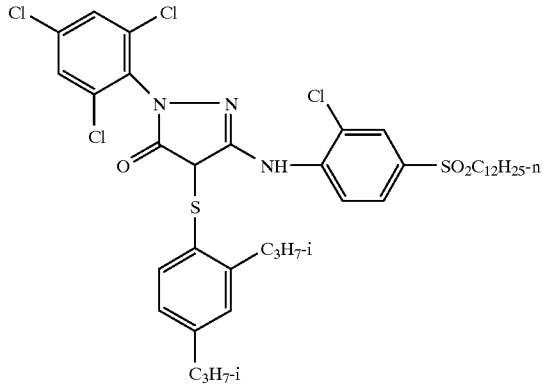

18. A photographic element according to claim 1, further comprising one or more magenta dye-forming imaging couplers comprising a pyrazole or imidazole ring compounds of the formula:

IA

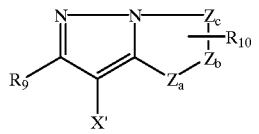

or

IB

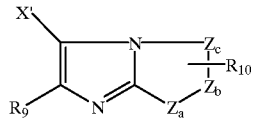

wherein $R_9$ and each $R_{10}$ are independently hydrogen or substituents that do not prevent the coupling reaction of the coupler; X' is hydrogen or a coupling-off group known in the photographic art; and $Z_a$, $Z_b$ and $Z_c$ are independently selected from the group consisting of a substituted or unsubstituted methine group, =N—, =C< or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring.

* * * * *